United States Patent [19]

Marinoni

[11] Patent Number: 4,689,853

[45] Date of Patent: Sep. 1, 1987

[54] HINGE MEMBER FOR AN ALL-GLASS PLATE MEMBER INCLUDING A METAL FITTING

[75] Inventor: Mario Marinoni, Magenta, Italy

[73] Assignee: Casma di V. Marinoni & Figli, Magenta, Italy

[21] Appl. No.: 850,976

[22] Filed: Apr. 11, 1986

[30] Foreign Application Priority Data

Oct. 25, 1985 [DE] Fed. Rep. of Germany ..... 3538964

[51] Int. Cl.[4] ..... E05D 5/02

[52] U.S. Cl. ..... 16/382; 16/DIG. 40

[58] Field of Search ..... 16/252, 382, DIG. 40

[56] References Cited

U.S. PATENT DOCUMENTS

| | | | |
|---|---|---|---|
| 4,535,503 | 8/1985 | Narita et al. | 16/382 |

FOREIGN PATENT DOCUMENTS

| | | | |
|---|---|---|---|
| 500650 | 3/1954 | Canada | 16/382 |
| 2063015 | 7/1972 | Fed. Rep. of Germany | 16/382 |
| 2403133 | 7/1975 | Fed. Rep. of Germany | 16/382 |
| 1458678 | 11/1966 | France | 16/382 |
| 469171 | 4/1969 | Switzerland | 16/382 |
| 2137691 | 10/1984 | United Kingdom | 16/382 |

*Primary Examiner*—Fred Silverberg
*Attorney, Agent, or Firm*—Toren, McGeady & Associates

[57] ABSTRACT

A metal fitting for an all-glass plate member for use as a door, window or the like and including a pair of clamping plates positioned on the opposite face surfaces of the plate member and covering a recess through the plate member. Each clamping plate has an elongated recess aligned with the recess in the plate member. The recess in the plate member and the recesses in the clamping plates define a receiving space for a hinge member. The hinge member is formed of at least two hinge member parts each associated with a different clamping plate with the hinge member plates located within the receseses in the clamping plates. The clamping plate recesses have a pair of shoulders each located at an opposite end of the recess. The hinge member parts bear against the shoulders. The hinge member includes an intermediate part located within the recess in the plate member. On one side the intermediate part has a projecting region in contact with one of the hinge member parts. Bolts interconnect the hinge member parts including the intermediate part.

12 Claims, 5 Drawing Figures

HINGE MEMBER FOR AN ALL-GLASS PLATE MEMBER INCLUDING A METAL FITTING

BACKGROUND OF THE INVENTION

The present invention is directed to a metal fitting for an all-glass plate member such as for a door, window, glass transoms, or display window panel. The all-glass plate member has a recess extending between its opposite face surfaces and a pair of clamping plates are arranged to be located on the opposite face surfaces of the plate member and to be interconnected. Each of the clamping plates has an elongated recess aligned with the recess in the plate member. The recesses are arranged to receive a hinge member.

Metal fittings of this type are known. In such known metal fittings the hinge members or elements are attached at carriers or supports located at the clamping plates and they contact the all-glass plate member. The carriers protrude from the front face of the all-glass plate member. This is true for hinge elements in the shape of hinge lugs. The hinge pins must also engage into specially designed door bottom locks and their insert spaces tends to collect dust.

SUMMARY OF THE INVENTION

The primary object of the present invention is to provide a metal fitting which does not project beyond the edges of the all-glass plate member and can be secured over a large area so that the all-glass plate member is stressed only over an area and not at individual points.

In accordance with the present invention, the hinge member is made up of at least two hinge member parts each arranged to fit into a different one of the recess in the clamping plates. The recesses in the clamping plates have shoulders at their opposite ends so that the shoulders project into the recesses. The hinge member parts have spaced end sections arranged to seat against the shoulders in the recesses. One hinge member part has a projecting region extending toward the other hinge member part with the projecting region located between the end sections. The hinge member parts are interconnected by bolts or the like.

In the present invention, the clamping plates can be formed to cover a large area and the portions of the all-glass plate members extending between the edge parallel to the hinge axis and the recess through the plate member can be comparatively wide. In spite of this dimensional feature, the hinge axis can be located relatively close to the edge parallel to the hinge axis, that is, in the range of 45 to 65 mm. The height of the clamping plates can be selected in accordance with the respective strength requirements. The hinge members are supported only on the shoulders in the recesses and at the clamping plates and, accordingly, do not apply point loads to the all-glass plate member. By tightening the bolts, the hinge member parts are fastened to the clamping plates and the glass clamping force of the clamping plates is increased.

For the adjustment of the hinge member, a certain amount of play is provided between the ends of the shoulders in the recesses and the ends of the hinge member parts.

Generally, only the upper hinge member has to be adjusted, the lower hinge member can seat tightly between the shoulders. In a particularly simple form the hinge member can be made up of two hinge member parts with one part seated within the recess in one clamping plate and projecting through the recess in the all-glass plate member with another hinge member part located in the other clamping plate. Where particularly heavy stresses are developed, the hinge member can be formed of three parts, two hinge member parts each located in a different one of the recesses in the clamping plate and an intermediate part located within the recess in the plate member.

The portion of the hinge member located within the recess in the plate member can be provided with a hinge connection for a swing leaf. In addition, the hinge member can include a support for a door leaf or window with a stop located on one side of the plate member. In an extremely simple arrangement, the recesses in the all-glass plate member can be formed as at least part of a circle so that the recesses can be formed by a drilling machine.

The various features of novelty which characterize the invention are pointed out with particularity in the claims annexted to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
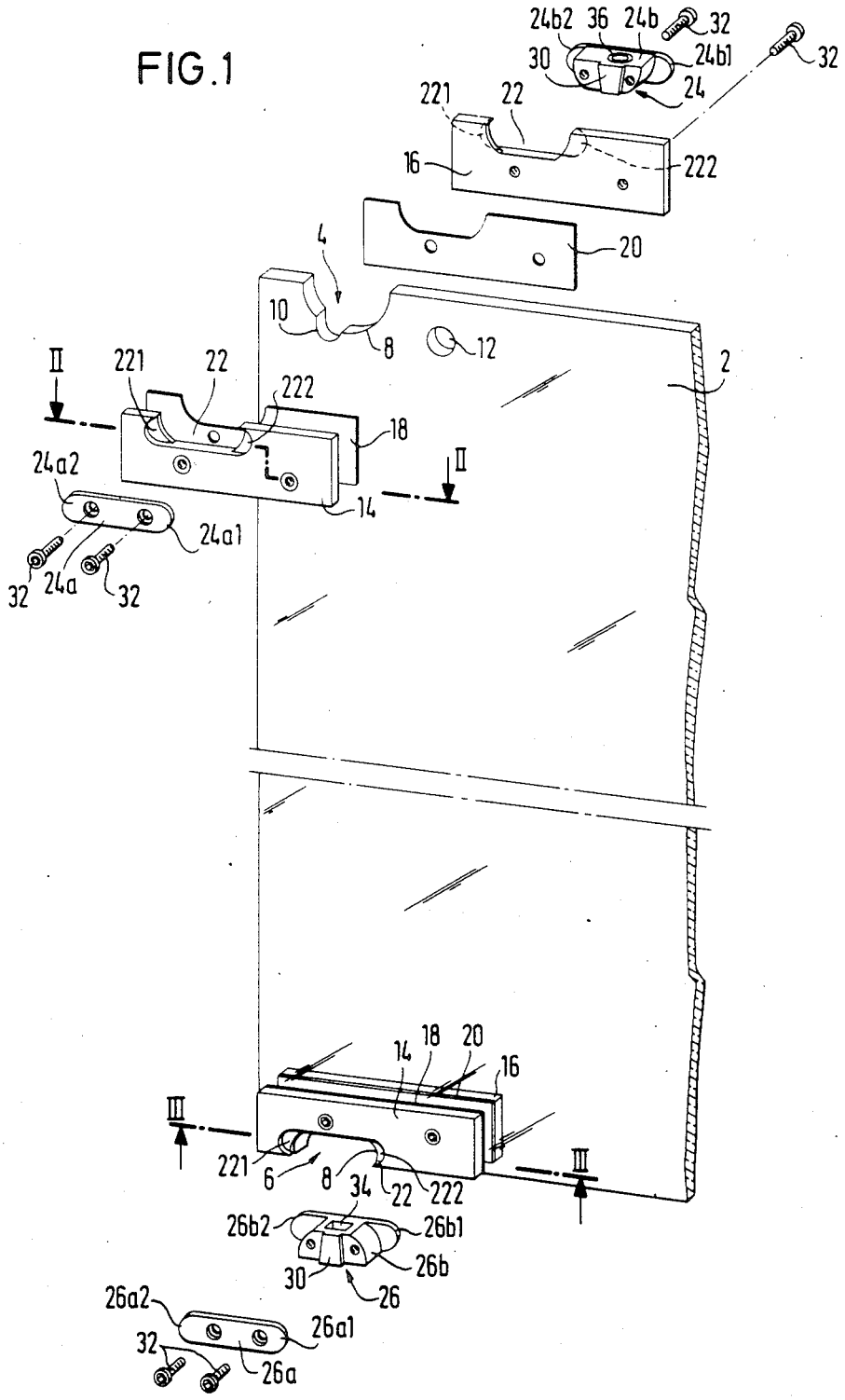
FIG. 1 is a partial elevational view of an all-glass door leaf with the metal fittings for the door leaf shown in an exploded arrangement.
Figure 2:
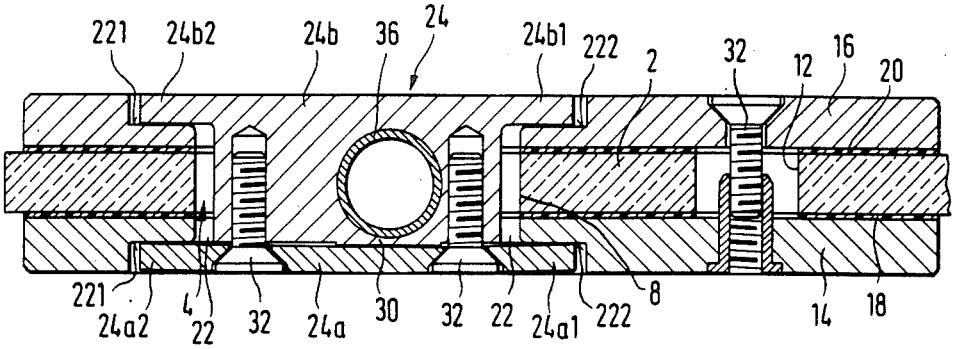
FIG. 2 is a cross-sectional view taken along the line II—II in FIG. 1.
Figure 3:
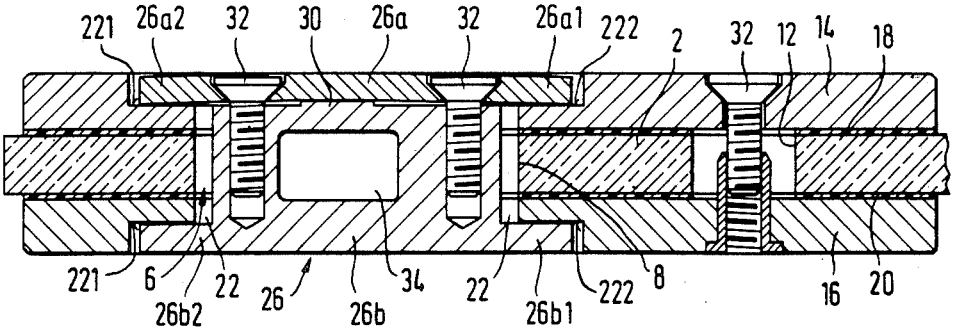
FIG. 3 is a cross sectional view taken along the line III—III in FIG. 1.

As shown in FIGS. 1–3, an all-glass plate member 2 has a pair of oppositely directed face surfaces and edge surfaces extending between the face surfaces. As viewed in FIG. 1 the upper end of the plate member is the top and the lower end is the bottom. An edge recess 4 is located in the top edge and another edge recess 6 is located in the bottom edge. Each recess is defined by an edge surface forming at least a part of a circle 8, 10. The edge recess 4, 6 can be formed by a drilling machine. Further, on the opposite side of the recess from the vertical edge adjacent the recess, a circular bore 12 is formed adjacent the top and bottom edges of the plate member. At the opposite face surfaces of the all-glass plate member 2 a pair of clamping plates 14, 16 are provided extending over the edge recesses 4, 6 so that they bear against the face surface located around the recesses. Soft pressure distribution shims or intermediate layers 18, 20 are located between the clamping plates and the face surfaces of the plate member 2. Preferably the shims 18, 20 are formed of Klingerite or nylon.

Each of the clamping plates 14, 16 has an elongated recess 22 in its edge extending along the corresponding edge of the plate member 2 so that the recesses align with the recesses 4, 6 through the plate member 2 and form a receiving space for hinge member 24 for the top of the plate member and hinge member 26 for the bottom of the hinge member, such as for a swinging door. Each hinge member 24, 26 is formed of two hinge member parts 24*a*, 24*b* and 26*a*, 26*b* so that each hinge member part can be inserted from an opposite side of the plate member extending into the receiving space formed by the recesses 4, 6, 22. The recesses in the clamping plates 14, 16 have shoulders 221, 222 at the opposite ends of the recesses spaced apart in the direction of the top and bottom edges of the plate member. The hinge member parts 24*a*, 24*b*, and 26*a*, 26*b* each have end sections 24*a*1, 24*a*2; 24*b*1, 24*b*2; 26*a*1, 26*a*2; 26*b*1, 26*b*2 which bear against the shoulders 221, 222. As can be seen in FIGS. 2 and 3, there is a certain amount of play within the recesses 22 between the ends of the recesses where the shoulders are located and the adjacent ends of the end sections of the hinge member parts. The hinge member parts 24*b* and 26*b* each have a part which extends through the recess 4, 6 in the plate member with a projecting region 30 centered between the ends of the recesses. The projecting region 30 bears against the middle region of the other hinge member part 24*a*, 26*a* when the parts are secured together. On the opposite side of the projecting region, bolts 32 extend through the hinge member parts 24*a*, 24*b* and 26*a*, 26*b* for securing and tightening the hinge member parts together. When the hinge member parts are tightened by the bolts 32, the hinge member parts 24*a*, 26*a* bends slightly and grips tightly at the shoulders 221, 222 so that the hinge members 24, 26 fit tightly in the recesses 22 because of the clamping action. The bottom hinge member 26 has a hinge hole or opening 34 for receiving a hinge lug of a floor door lock. The top hinge member 24 has a hinge bushing extending through the hinge member part 24*b* which can be pushed over an upper cylindrical hinge lug.

Figure 4:
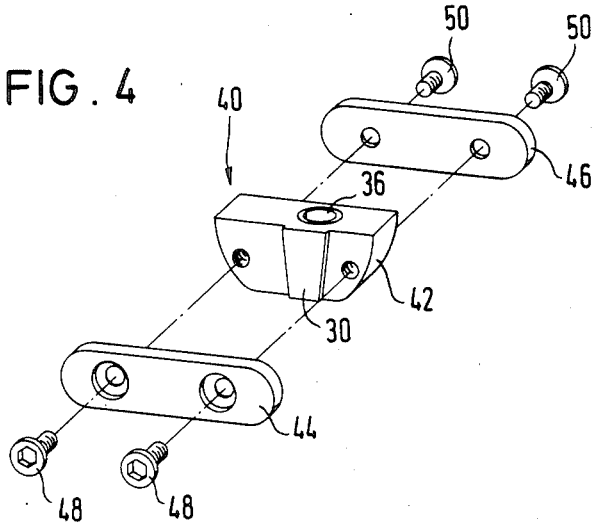
FIG. 4 is a perspective view in an exploded arrangement of a three-part hinge member, that is, the upper hinge member, for a swinging door.

In the embodiment just described each of the hinge members 24, 26 is made up of two hinge member parts. In FIG. 4 a hinge member 40 is shown made up of three parts for use on a swinging door with the hinge member consisting of an intermediate part 42 and two outer or side parts 44, 46 with bolts 48, 50 arranged to secure the side parts to the intermediate part.

Figure 5:
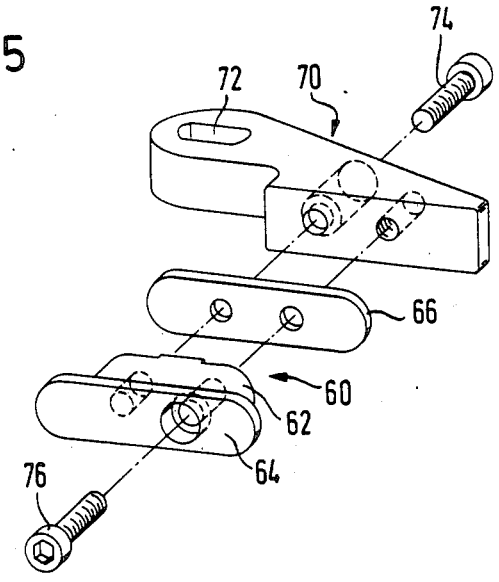
FIG. 5 is a perspective view in an exploded arrangement illustrating a hinge member for the lower end of a door including a backstop.

In FIG. 5 a two-part hinge member 60, an insert member with a liner part function, is formed of a side part 64 formed as a single unit with an intermediate part 62 and another side part 66. A support carrier 70 is secured to the separate side part 66 and forms a back stop for a door and has a hinge hole or opening 72 for an all-glass plate member which can be stopped on one side. The hinge member 60 and the carrier 70 are secured together by a pair of bolts 74, 76 which are secured from the opposite sides and are provided with countersunk heads for affording a burglar-proof construction. For the attachment of the carrier 70, the hinge member 60 has a part which has only a liner feature and a clamping function.

While specific embodiments of the invention have been shown and described in detail to illustrate the application of the inventive principles, it will be understood that the invention may be embodied otherwise without departing from such principles.

I claim:

1. Metal fitting for glass doors, windows, transoms and display window panels, comprising an all-glass plate member having a pair of opposite face surfaces and at least one pair of edges extending between said face surfaces, an elongated recess formed in each said edge and extending between said face surfaces, a pair of clamping plates each arranged to be located on an opposite one of said face surfaces, first means for interconnecting said clamping plates and for pressing said clamping plates against said plate member, said first interconnecting means extending through said plate member, each said pair of clamping plates having an elongated recess therein arranged to align with the recess in said edge and with one another with said clamping plates covering the face surfaces of said plate member in which the edge recess is formed, a hinge member arranged to be fitted into said recess in said edge and into said recesses in said clamping plates, said hinge member comprising at least two hinge member parts each arranged to fit into a different one of said recesses in said clamping plates, a shoulder at each end of said elongated recesses in said clamping plates with said shoulders projecting into said recesses and forming a support surface, each of said hinge member parts having spaced end sections and each said end section arranged to seat against the support surface of one of said shoulders in the recess of the corresponding said clamping plate, one said hinge member part having a projecting region thereon projecting outwardly therefrom toward the other said hinge member part with said projecting region located between and spaced from said end sections thereon, and second means for interconnecting said hinge member parts, said second interconnecting means comprising bolts extending through and interconnecting said hinge member parts and being spaced from and located between said projecting region and said end sections, the tightening of the bolts causing said other hinge member part to bend slightly about the projecting region and thereby grip tightly at the shoulders to cause the hinge member parts to fit tightly in the recesses.

2. Metal fitting, as set forth in claim 1, wherein said end sections of said hinge member parts fit within the recess of the corresponding said clamping plate with a certain amount of play between the ends of the recess at which the shoulders are located and the ends of said hinge member part forming the end sections thereof.

3. Metal fitting, as set forth in claim 1 or 2, wherein said at least two hinge member parts comprises a first hinge member part located within the recess in one of said clamping plates and having an intermediate part formed integrally therewith extending into the recess in said plate member, and a second hinge member part located in said recess in the other one of said clamping plates.

4. Metal fitting, as set forth in claim 1 or 2, wherein said at least two hinge member parts comprises a first hinge member part located in the recess in one of said clamping plates, a second hinge member part located in the recess in the other said clamping plate and an intermediate part located in the recess in said plate member and said first, second and intermediate hinge member parts being separate from one another, and being interconnected by said second interconnecting means.

5. Metal fitting, as set forth in claim 3, wherein said intermediate part of said hinge member comprises an opening arranged to receive a hinge element for pivotally mounting said plate member.

6. Metal fitting, as set forth in claim 4, wherein said intermediate part of said hinge member comprises an opening arranged to receive a hinge element for pivotally mounting said plate member.

7. Metal fitting, as set forth in claim 3, wherein a carrier having a hinge link is attached to one of said hinge member parts.

8. Metal fitting, as set forth in claim 7, wherein said carrier includes a stop member for said plate member.

9. Metal fitting, as set forth in claim 4, wherein a carrier having a hinge link is attached to one of said hinge member parts.

10. Metal fitting, as set forth in claim 9, wherein said carrier includes a stop member for said plate member.

11. Metal fitting, as set forth in claim 1 or 2, wherein said recess in said edge of said plate member being defined inwardly from said edge of said plate member by at least one circular arc whereby the recess in said plate member can be fabricated by a drilling machine.

12. Metal fitting, as set forth in claim 11, wherein said clamping plates extend across said recess in said plate member.

* * * * *

UNITED STATES PATENT AND TRADEMARK OFFICE

CERTIFICATE OF CORRECTION

PATENT NO. : 4,689,853

DATED : Sept. 1, 1987

INVENTOR(S) : Mario Marinoni

It is certified that error appears in the above-identified patent and that said Letters Patent is hereby corrected as shown below: Page 1:

"[30] Foreign Application Priority Data

Oct. 25, 1985 [DE] Fed.Rep.of Germany .....

3538964" should read as follows:

--[30] Foreign Application Priority Data

Oct. 25, 1985 [DE] Fed. Rep. of Germany .....

3538064--.

Signed and Sealed this

Twenty-eighth Day of March, 1989

*Attest:*

DONALD J. QUIGG

*Attesting Officer*

*Commissioner of Patents and Trademarks*